US007308073B2

(12) United States Patent
Tkaczyk et al.

(10) Patent No.: US 7,308,073 B2
(45) Date of Patent: Dec. 11, 2007

(54) X-RAY FILTER HAVING DYNAMICALLY DISPLACEABLE X-RAY ATTENUATING FLUID

(75) Inventors: J. Eric Tkaczyk, Delanson, NY (US); Deborah J. Walter, Burnt Hills, NY (US); Xiaoye Wu, Rexford, NY (US); Brian C. Bales, Niskayuna, NY (US); James W. Leblanc, Niskayuna, NY (US); Yanfeng Du, Rexford, NY (US)

(73) Assignee: General Electric Company, Niskayuna, NY (US)

( * ) Notice: Subject to any disclaimer, the term of this patent is extended or adjusted under 35 U.S.C. 154(b) by 90 days.

(21) Appl. No.: 11/163,496

(22) Filed: Oct. 20, 2005

(65) Prior Publication Data

US 2007/0092066 A1 Apr. 26, 2007

(51) Int. Cl.
*G21K 3/00* (2006.01)

(52) U.S. Cl. ..... 378/16; 378/156; 378/158; 378/159

(58) Field of Classification Search ..... 378/5, 378/16, 145, 147, 150, 151, 156, 157, 158, 378/159

See application file for complete search history.

(56) References Cited

U.S. PATENT DOCUMENTS 3,755,672 A * 8/1973 Edholm et al. ..... 378/158
4,804,885 A * 2/1989 Petersen et al. ..... 313/480
4,856,042 A * 8/1989 Staron et al. ..... 378/147
5,148,465 A * 9/1992 Mulder et al. ..... 378/156
5,559,853 A * 9/1996 Linders et al. ..... 378/159
5,568,533 A * 10/1996 Kumazaki et al. ..... 378/156
5,625,665 A * 4/1997 Fokkink et al. ..... 378/156
5,768,340 A * 6/1998 Geittner et al. ..... 378/159
5,878,111 A * 3/1999 Schulz ..... 378/158
5,966,426 A * 10/1999 Marra et al. ..... 378/159
6,061,426 A * 5/2000 Linders et al. ..... 378/149

(Continued)

FOREIGN PATENT DOCUMENTS

JP 05345614 A * 12/1993

OTHER PUBLICATIONS

U.S. Appl. NO. 10/765,618, filed Jan. 27, 2004, Toth et al., "System and Method of Collecting Imaging Subject Positioning Information for X-Ray Flux Control".

(Continued)

*Primary Examiner*—Allen C. Ho
(74) *Attorney, Agent, or Firm*—Jean K. Testa; Curtis B. Brueske

(57) ABSTRACT

A bowtie filter is constructed to have a fluidic envelope filled with attenuating fluid and a displacement insert that can present various x-ray attenuation profiles during a scan. The insert is designed to displace the attenuating fluid to achieve a denied attenuating or filtering profile. The insert can be rotated, twisted, moved, and otherwise contorted within the fluidic envelope as needed during the course of a scan. As the angle, position and shape of the zombie is changed, the x-ray profile of the filter changes. The insert may have a default shape when at rest, but can have its shape changed when external forces are placed thereon. As x-ray filtering needs change during the course of the scan, the insert can be compressed, stretched, and/or contorted to achieve additional filtering profiles.

20 Claims, 4 Drawing Sheets

U.S. PATENT DOCUMENTS

| | | | | |
|---|---|---|---|---|
| 6,118,855 | A * | 9/2000 | Welters et al. | 378/158 |
| 6,188,749 | B1 * | 2/2001 | Schiller et al. | 378/158 |
| 6,198,806 | B1 * | 3/2001 | Prins | 378/159 |
| 6,252,939 | B1 * | 6/2001 | Young et al. | 378/156 |
| 6,275,568 | B1 * | 8/2001 | Prins et al. | 378/158 |
| 6,426,999 | B2 * | 7/2002 | Prins | 378/156 |
| 6,836,535 | B2 * | 12/2004 | Toth et al. | 378/159 |
| 6,920,203 | B2 * | 7/2005 | Short et al. | 378/147 |
| 6,990,171 | B2 | 1/2006 | Toth et al. | 378/16 |
| 7,068,750 | B2 | 6/2006 | Toth et al. | 378/16 |
| 7,068,751 | B2 | 6/2006 | Toth et al. | 378/20 |
| 7,082,189 | B2 * | 7/2006 | Yahata et al. | 378/156 |
| 7,149,278 | B2 | 12/2006 | Arenson | 378/19 |
| 2004/0264627 | A1 | 12/2004 | Besson | |

OTHER PUBLICATIONS

U.S. Appl. No. 10/904,116, filed Oct. 25, 2004, Arenson et al., "Apparatus for Acquisition of CT Data With Penumbra Attenuation Calibration".

U.S. Appl. No. 10/904,736, filed Nov. 24, 2004, Arenson et al., "Method and System of CT Data Correction".

* cited by examiner

X-RAY FILTER HAVING DYNAMICALLY DISPLACEABLE X-RAY ATTENUATING FLUID

BACKGROUND OF THE INVENTION

The present invention relates generally to radiographic imaging and, more particularly, to an x-ray filter having dynamically displaceable x-ray attenuating fluid.

Typically, in radiographic systems, an x-ray source emits x-rays toward a subject or object, such as a patient or a piece of luggage. Hereinafter, the terms "subject" and "object" may be interchangeably used to describe anything capable of being imaged. The x-ray beam, after being attenuated by the subject, impinges upon an array of radiation detectors. The intensity of the radiation beam received at the detector array is typically dependent upon the attenuation of the x-rays through the scanned object. Each detector element of the detector array produces a separate signal indicative of the attenuated beam received by each detector element. The signals are transmitted to a data processing system for analysis and further processing which ultimately produces an image. Generally, the x-ray source and the detector array are rotated about the gantry within an imaging plane and around the subject. X-ray sources typically include x-ray tubes, which emit the x-ray beam at a focal point. X-ray detectors typically include a collimator for collimating x-ray beams received at the detector, a scintillator for converting x-rays to light energy adjacent the collimator, and photodiodes for receiving the light energy from the adjacent scintillator and producing electrical signals therefrom.

In a similar fashion, radiation detectors are employed in emission imaging systems such as used in nuclear medicine (NM) gamma cameras and Positron Emission Tomography (PET) systems. In these systems, the source of radiation is no longer an x-ray source, rather it is a radiopharmaceutical introduced into the body being examined. In these systems each detector of the array produces a signal in relation to the localized intensity of the radiopharmaceutical concentration in the object. Similar to conventional x-ray imaging, the strength of the emission signal is also attenuated by the inter-lying body parts. Each detector element of the detector array produces a separate signal indicative of the emitted beam received by each detector element. The signals are transmitted to a data processing system for analysis and further processing which ultimately produces an image.

In most computed tomography (CT) imaging systems, the x-ray source and the detector array are rotated about a gantry encompassing an imaging volume around the subject. X-ray sources typically include x-ray tubes, which emit the x-rays as a fan or cone beam from the anode focal point. X-ray detector assemblies typically include a collimator for reducing scattered x-ray photons from reaching the detector, a scintillator adjacent to the collimator for converting x-rays to light energy, and a photodiode adjacent to the scintillator for receiving the light energy and producing electrical signals therefrom. Typically, each scintillator of a scintillator array converts x-rays to light energy. Each photodiode detects the light energy and generates a corresponding electrical signal. The outputs of the photodiodes are then transmitted to the data acquisition system and then to the processing system for image reconstruction.

For radiographic imaging, such as x-ray imaging and computed tomography, x-ray exposure of a subject is always a concern. The amount of irradiation seen by a scan subject is generally referenced as "x-ray dose" and is factor that is paramount in prescribing a scan. That is, image quality is greatly influenced by the x-ray dose during data acquisition. In this regard, at higher dose levels, SNR is greater, which leads to better image quality. At higher dosage levels, however, the subject is exposed to greater amounts of irradiation. As there are strict guidelines to the amount of irradiation that a subject can experience, practitioners must limit x-ray dose and, as a result, sacrifice image quality. So, when prescribing a scan, practitioners choose a dosage level that will provide the best image quality without exceeding mandated irradiation levels.

Adding to the difficulty in setting dosage levels is that subjects, such as medical patients, lack a uniform thickness. This is particularly problematic for CT systems where each view in a complete scan rotation presents a different angle of x-ray illumination to the subject. As such, it is difficult to optimize x-ray dose on a view-by-view basis. Moreover, subjects generally have variable attenuation characteristics across a given field-of-view. More specifically and in the context of medical patients, outside the skin line, there is no attenuation and the full flux of the x-ray beam is incident on the x-ray detector. Just within the skin line, the attenuation is much larger relative to outside the skin line and, as a result, fewer x-rays reach the detector. Since the x-ray source during a scan is operated so that the number of x-ray photons within the center of the field-of-view is sufficient to create an image, e.g., low noise, the excessive photons at the skin line interface are unnecessary for image quality. Typically, without a proper x-ray management device, this increased photon number at the skin interface imports additional dose to the subject and results in x-ray scatter into the imaged region. Therefore, it has been desirable to reduce the x-ray flux outside the imaging volume and to do so with each view. This is increasingly desirable for detectors that saturate at low x-ray flux levels.

That is, energy discriminatory and photon counting detectors have a much lower saturation limit than conventional, energy integrating detectors. Despite the drawbacks associated with low flux saturation, photon counting detectors are desirable in order to ascertain energy information of the x-rays detected by the detectors which can be used for material discrimination. However, because direct conversion, photon counting detectors typically having a low flux rate limit, such as about 1 million cnts/sec/mm$^2$), their use has been significantly limited.

Additionally, the concerns of increased x-ray photons are not isolated to the skin line interface. If the field-of-view is relatively uniform for all views, then abrupt x-ray flux changes will only be experienced at the edge of the field-of-view. However, for medical imaging, such a case is rare. Typically, the asymmetry of the object being imaged results in very different flux profiles for different views. The impact of this variance can be mitigated if the center of the field-of-view has the thickest cross-section and the field-of-view boundary is marked by relatively high flux transition. However, if the object to be imaged is off-centered, then one side of the detector will see much higher flux rates than other side of the detector and this will change on a per view basis. It is also possible to have a great degree of variability within the field-of-view if the internal composition of the object causes large variations in signal level across the field-of-view. One skilled in the art will appreciate that numerous flux conditions other than those presented above can be encountered and lead to detector saturation and/or areas of unneeded x-ray flux.

Heretofore, fixed shaped filters have been used to selectively attenuate x-rays at the edges of the field-of-view more than at the center of the field-of-view. A common fixed shape filter is generally referenced as a "bowtie" filter and is commonly used in CT systems to compensate for the thickest-in-the-middle characteristic of most medical patients. Known bowtie filters, however, are fixed in their shape and, thus, to accommodate the variations that could be encountered in a scan subject population, CT systems are generally equipped with several discrete bowtie filters. Not only does this lead to increased costs, but because the filters are static, the filters cannot be optimized for dynamic changes that occur as the source-detector rotates during a CT scan. In this regard, known bowties are ineffective in preventing detector saturation across the several views of a CT scan and can result in increased dosage levels to maintain image quality.

It would therefore be desirable to design an x-ray flux management device that is effective in reducing detector saturation under high x-ray flux conditions while not compromising data acquisition under low x-ray flux conditions. It would also be desirable to have such an x-ray flux management device that provides further optimization of radiation dose during a scan.

BRIEF DESCRIPTION OF THE INVENTION

The present invention is a directed an x-ray flux management device that overcomes the aforementioned drawbacks.

Conventional CT imaging scanners utilize detectors that convert x-ray photon energy into current signals that are integrated over a time period, then measured and ultimately digitized. A drawback of such detectors is their inability to provide independent data or feedback as to the energy and incident flux rate of photons detected. That is, conventional CT detectors have a scintillator component and photodiode component wherein the scintillator component illuminates upon reception of x-ray photons and the photodiode detects illumination of the scintillator component, and provides an integrated electrical current signal as a function of the intensity and energy of incident x-ray photons. While it is generally recognized that CT imaging would not be a viable diagnostic imaging tool without the advancements achieved with conventional CT detector design, a drawback of these integrating detectors is their inability to provide energy discriminatory data or otherwise count the number and/or measure the energy of photons actually received by a given detector element or pixel. Accordingly, the present invention is particularly applicable with CT systems having energy discriminating detectors that can provide photon counting and/or energy discriminating feedback.

Energy discriminating detectors are capable of not only x-ray counting, but also providing a measurement of the energy level of each x-ray detected. While a number of materials may be used in the construction of an energy discriminating detector, including scintillators and photodiodes, direct conversion detectors having an x-ray photoconductor, such as amorphous selenium or cadmium zinc telluride, that directly convert x-ray photons into an electric charge have been shown to be among the preferred materials. A drawback of photon counting detectors, however, is that these types of detectors have limited count rates and have difficulty covering the broad dynamic ranges encompassing very high x-ray photon flux rates typically encountered with conventional CT systems. Generally, a CT detector dynamic range of 1,000,000 to one is required to adequately handle the possible variations in photon flux rates. In the very fast scanners now available, it is not uncommon to encounter x-ray flux rates of over $10^8$ photons/$mm^2$/sec when no object is in the scan field, with the same detection system needing to count only 10's of photons that manage to traverse the center of large objects.

The very high x-ray photon flux rates ultimately lead to detector saturation. That is, these detectors typically saturate at relatively low x-ray flux levels. This saturation can occur at detector locations wherein small subject thickness is interposed between the detector and the radiographic energy source or x-ray tube. It has been shown that these saturated regions correspond to paths of low subject thickness near or outside the width of the subject projected onto the detector array. In many instances, the subject is more or less cylindrical in the effect on attenuation of the x-ray flux and subsequent incident intensity to the detector array. In this case, the saturated regions represent two disjointed regions at extremes of the detector array. In other less typical, but not rare instances, saturation occurs at other locations and in more than two disjointed regions of the detector. In the case of a cylindrical subject, the saturation at the edges of the array can be reduced by the imposition of a bowtie filter between the subject and the x-ray source. Typically, the filter is constructed to match the shape of the subject in such a way as to equalize total attenuation, filter and subject, across the detector array. The flux incident to the detector is then relatively uniform across the array and does not result in saturation. What can be problematic, however, is that the bowtie filter may not be optimum given that a subject population is significantly less than uniform and not exactly cylindrical in shape nor centrally located in the x-ray beam. In such cases, it is possible for one or more disjointed regions of saturation to occur or conversely to over-filter the x-ray flux and unnecessarily create regions of very low flux. Low x-ray flux in the projection results in a reduction in information content which will ultimately contribute to unwanted noise in the reconstructed image of the subject.

Generally, high-sensitivity photon counting radiation detectors are constructed to have a relatively low dynamic range. This is generally considered acceptable for proton counting detector applications since high flux conditions typically do not occur. In CT detector designs, low flux detector readings through the subject are typically accompanied by areas of high irradiation in air, and/or within the contours of the scan subject requiring CT detectors to have very large dynamic range responses. Moreover, the exact measurement of photons in these high-flux regions is less critical than that for low-flux areas where each photon contributes an integral part to the total collected photon statistics. Notwithstanding that the higher flux areas may be of less clinical or diagnostic value, images reconstructed with over-ranging or saturated detector channel data can be prone to artifacts. As such, the handling of high-flux conditions is also important.

The present invention includes an x-ray flux management device designed to prevent saturation of photon counting x-ray systems having detector channels characterized by low dynamic range. Dynamic range of a detector channel defines the range of x-ray flux levels that the detector channel can handle to provide meaningful data at the low-flux end and not experience over-ranging or saturating at the high flux end. Notwithstanding the need to prevent over-ranging, to provide diagnostically valuable data, the handling of low-flux conditions, which commonly occur during imaging through thicker cross-sections and other areas of limited x-ray transmission, is also critical in detector design. As such, the x-ray flux management device described herein is designed to satisfy both high flux and low flux conditions.

A bowtie filter is presented that can present various x-ray attenuation profiles during a scan. The filter is constructed to have a fluidic envelope filled with attenuating fluid and a displacement insert or "zombie." This zombie is designed to displace the attenuating fluid to achieve a desired attenuating or filtering profile. In this regard, the zombie can be rotated, twisted, moved, and otherwise contorted within the fluidic envelope as needed during the course of a scan. As the position and shape of the zombie is changed, the x-ray profile of the filter changes. In one preferred embodiment, the zombie is constructed from viscoelastic or elastomeric material that has a memory. In this regard, the zombie is constructed to have a complex shape when at rest, but can have its shape changed when external forces are placed thereon. As such, in this preferred embodiment, the zombie is constructed to have a shape matched to that of a typical medical patient when at rest. As the x-ray filtering needs change during the course of the scan, the filter can be rotated, compressed, stretched, and/or contorted to achieve additional filtering profiles.

Therefore, in accordance with one aspect of the present invention, an x-ray attenuating filter is presented that includes an envelope containing x-ray accumulating fluid. The filter further has a fluid displacement device disposed within the envelope and configured to displace the x-ray attenuating fluid.

According to another aspect, the present invention includes a CT system having an x-ray source, an x-ray detector, and an x-ray filter assembly disposed between the x-ray detector and the x-ray source along a path of irradiation. The x-ray filter assembly has a bowtie filter having a body with accumulating fluid disposed therein as well as an attenuating fluid displacement device sealingly enclosed within the body of the bowtie filter. The filter assembly further has a mechanized actuator connected to the attenuating fluid displacement device to dynamically position the attenuating fluid displacement device within the body of the bowtie filter to define a desired filtering profile for the bowtie filter.

According to yet a further aspect of the present invention, an x-ray filter has a fluidic envelope having x-ray attenuating fluid disposed therein. The attenuating fluid is designed to filter x-rays projected from an x-ray source for an object to be scanned. The x-ray filter further has means for displacing the x-ray attenuating fluid within the fluidic envelope to achieve a desired x-ray filtering profile to prevent detector saturation during scanning of the object In accordance with yet a further aspect of the invention, an x-ray filter is presented that includes a fluidic envelope having x-ray attenuating fluid disposed therein. The x-ray attenuating fluid includes at least one of liquid metal, nanoparticles suspended in a non-settling solution, or a compound with pH control buffer dissolved in a liquid.

Various other features and advantages of the present invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION OF THE PREFERRED EMBODIMENT

The operating environment of the present invention is described with respect to a four-slice computed tomography (CT) system. However, it will be appreciated by those skilled in the art that the present invention is equally applicable for use with single-slice or other multi-slice configurations. Moreover, the present invention will be described with respect to the detection and conversion of x-rays. However, one skilled in the art will further appreciate that the present invention is equally applicable for the detection and conversion of other high frequency electromagnetic energy.

While the present invention is applicable with a number of radiographic imaging systems, it is particularly well-suited for CT systems and, especially, those systems having detectors with relative small dynamic range, such as photon counting and energy discriminating detectors. In this regard, the present invention is believed to be a key enabler for the use of direct conversion and energy discriminating/photon counting detectors with conventional CT systems. Additionally, the invention is believed to be effective in limiting radiation exposure without sacrificing image quality.

Figure 1:
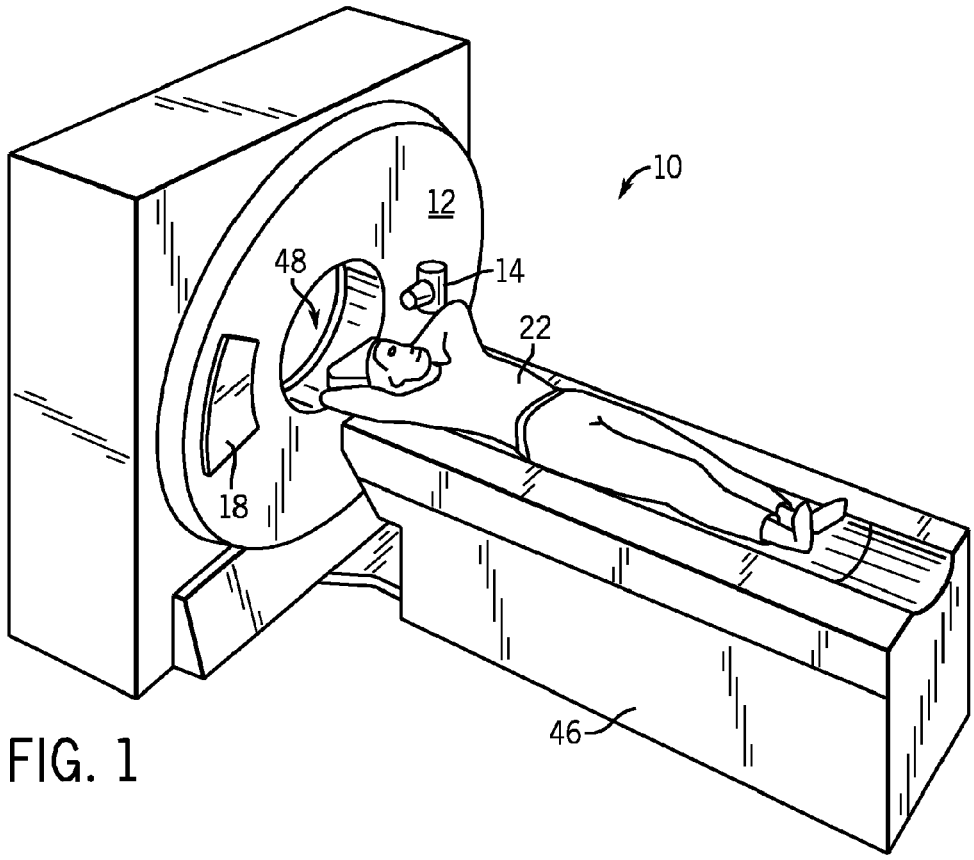
FIG. 1 is a pictorial view of a CT imaging system.
Figure 2:
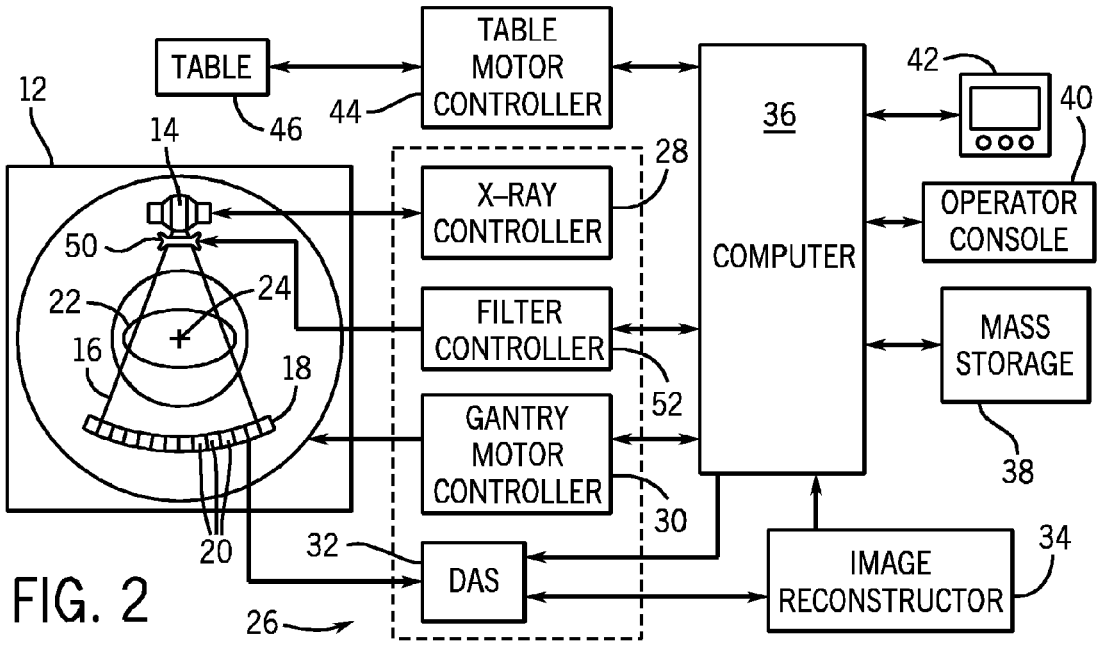
FIG. 2 is a schematic diagram of the system illustrated in FIG. 1.

Referring to FIGS. 1 and 2, an exemplary computed tomography (CT) imaging system 10 is shown as including a gantry 12 representative of a "third generation" CT scanner. Gantry 12 has an x-ray source 14 that projects a beam of x-rays 16 toward a detector array 18 on the opposite side of the gantry 12. Detector array 18 is formed by a plurality of detectors 20 which together sense the projected x-rays that pass through a medical patient 22. Each detector 20 produces an electrical signal that represents the intensity of an impinging x-ray beam and hence the attenuated beam as it passes through the patient 22. In one preferred embodiment, each detector is capable of providing energy level and photon count information. During a scan to acquire x-ray projection data, gantry 12 and the components mounted thereon rotate about a center of rotation 24.

Rotation of gantry 12 and the operation of x-ray source 14 are governed by a control mechanism 26 of CT system 10. Control mechanism 26 includes an x-ray controller 28 that provides power and timing signals to an x-ray source 14 and a gantry motor controller 30 that controls the rotational speed and position of gantry 12. A data acquisition system (DAS) 32 in control mechanism 26 samples analog data from detectors 20 and converts the data to digital signals for subsequent processing. An image reconstructor 34 receives sampled and digitized x-ray data from DAS 32 and performs high speed reconstruction. The reconstructed image is applied as an input to a computer 36 which stores the image in a mass storage device 38.

Computer 36 also receives commands and scanning parameters from an operator via console 40 that has a keyboard. An associated cathode ray tube display 42 allows the operator to observe the reconstructed image and other data from computer 36. The operator supplied commands and parameters are used by computer 36 to provide control signals and information to DAS 32, x-ray controller 28, gantry motor controller 30, and filter controller 52. In addition, computer 36 operates a table motor controller 44 which controls a motorized table 46 to position patient 22 and gantry 12. Particularly, table 46 moves portions of patient 22 through a gantry opening 48.

As will be described in greater detail below, system 10 further has an x-ray filter 50 that is positioned between x-ray source 14 and detector array 18. The filter 50 is constructed to define various filtering profiles during the course of a scan. In this regard, the filter is operationally connected to a filter controller 52 that controls a motor and actuator to effectuate changes in the angle, position, shape, and otherwise orientation of attenuating fluid disposed in the filter.

Figure 3:
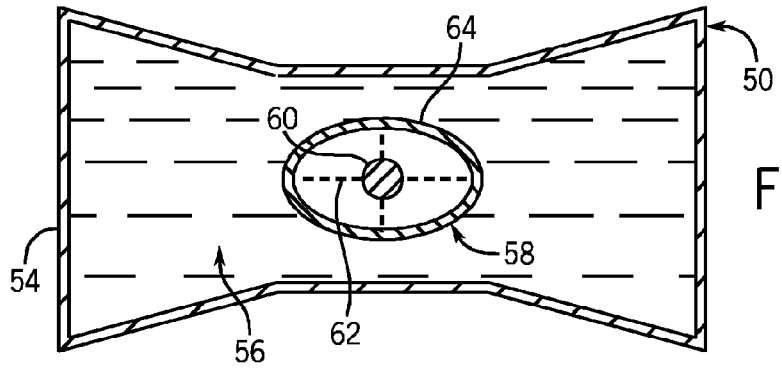
FIG. 3 is a cross-sectional view of a bowtie filter according to the present invention.

Referring now to FIG. 3, a cross-sectional view of filter 50 is shown. As illustrated, filter 50 preferably is constructed to have a fluidic envelope 54 defined by a rigid body enclosing x-ray attenuating fluid 56. The attenuating fluid 56 surrounds an x-ray fluid attenuating insert or "zombie" 58. As will be described, the zombie 58 may be rotated and/or translated by a rotor assembly 60. The zombie is also connected to an armature 62 that, as will be described, can effectuate changes in the shape thereof. The zombie is preferably constructed to have an elastomeric or viscoelastic shell 64 that is filled with foam or air.

The attenuating fluid is preferably a dense fluid, such as liquid mercury or other liquid metals, with low-melting temperatures. However, it is contemplated that the fluid may be a combination of several liquid metals. Additionally, the attenuating fluid may take the form of high density powders or nanoparticles suspended in a non-settling colloidal suspension. In this regard, it is contemplated that tungsten or similar powders may be used, such as tungsten oxide mixed with a paint-binder system. It is further recognized that high density salts and other compounds with pH control buffers to provide stability dissolved in water, oil, or other liquids may also be used. For example, alkali halide salts in water, such as potassium iodide or cesium iodide are believed to be particularly applicable. In one preferred embodiment, the attenuating fluid comprises $Na_2WO_4$ in a solution of water, oil, organic, or non-organic liquid. Molecular liquids such as hexaiodobenzene are also believed to be practical as well as lubricous nanoparticles/liquid composites with low steric hindrance to zombie rotation. Ferro-fluids such as colloidal suspension of iron oxide particles may also be used.

Figure 4:
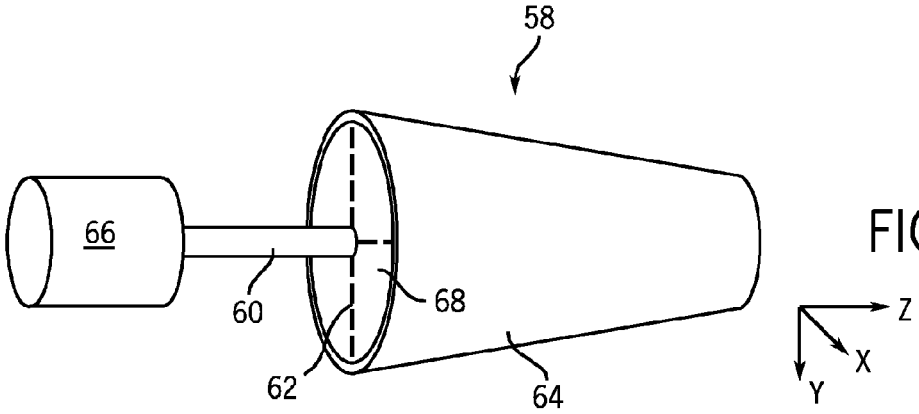
FIG. 4 is a perspective view of an x-ray attenuating fluid displacement device according to the present invention.

As described above, filter 50 is constructed to have a fluidic envelope containing high density x-ray attenuating fluid that is displaced by a zombie. The zombie, as illustrated in FIG. 4, has a plastic or elastomeric shell 64 that is preferably filled with foam or air. The shell can be rotated via rotor shaft 60 by actuator 66. The actuator can effectuate rotation and/or translation of the zombie within the fluidic envelope. The zombie further has an armature 62 that is connected to zombie face plate 68. The armature is connected to rotor shaft 60 and, when commanded, causes rotation of the shell 64. Additionally, the rotor shaft can also translate the zombie within the fluidic envelope.

Figure 5:
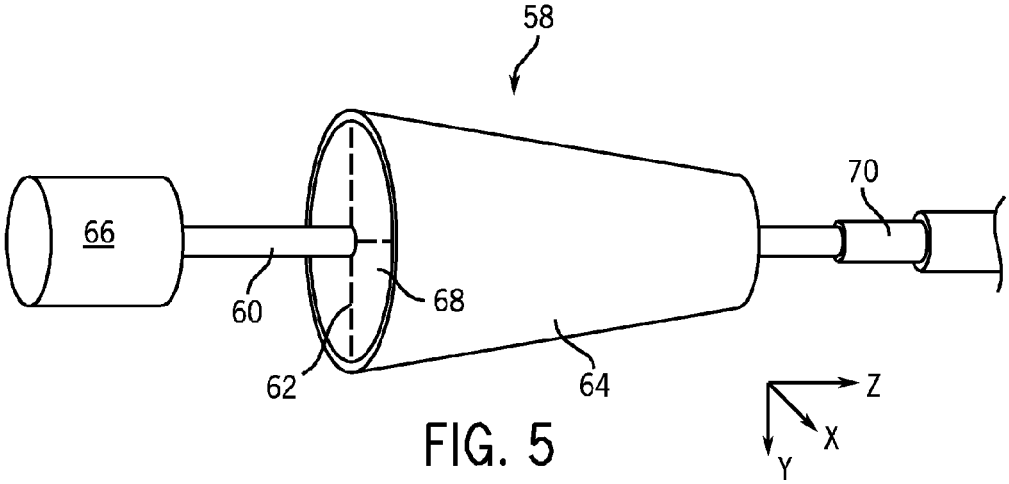
FIG. 5 is a perspective view of an x-ray attenuating fluid displacement device according to another aspect of the present invention.

In the illustrated example, zombie 58 has one end connected to a motion controller 66 and another end that is free-floating. In this regard, the zombie may be translated or rotated freely within the fluidic envelope. However, the shape of the zombie cannot be adjusted. Accordingly, in another embodiment and as shown in FIG. 5, shell 64 is connected to pivot shaft 70 that sealingly extends into the fluid envelope. The pivot shaft preferably has a telescopic construction to support translation of the shell. Moreover, the pivot shaft provides a fixed point by which the shell can be rotated. As a result, the shape of the zombie can be contorted to provide a desired attenuating profile. Moreover, it is contemplated that when the telescoping pivot shaft is fully extended, the shell can be further translated away from the pivot shaft to achieve a stretching of the shell. Conversely, when the pivot shaft is fully retracted, the shell can be translated toward the shaft to compress the shell. Both of which provide additional flexibility in defining a desired x-ray attenuation profile. Additionally, not only is actuator 66 capable of translating and rotating the zombie shell, but it is further contemplated that the actuator may provide tilting of the shell when needed.

Figure 6:
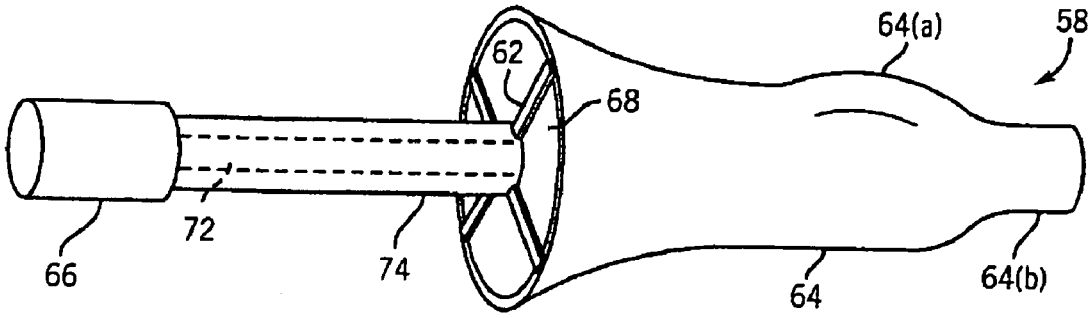
FIG. 6 is a perspective view of an x-ray attenuating fluid displacement device according to yet another aspect of the present invention.

Referring now to FIG. 6, another embodiment of the present invention is shown. In this embodiment, shell 64 is constructed to have a complex shape when at rest. In this regard, when external forces are not applied to the shell, the shell provides a unique, complex shape that is mirrored by the attenuating fluid in the fluid envelope. Moreover, the shell is constructed of material that will automatically retain this complex shape after external forces applied thereon are removed. Thus, if the shell is contorted to have a different shape, once those contorting forces are removed, the shell will return to its at-rest shape. In the exemplary zombie illustrated in FIG. 6, the shell has a generally frustoconical shape defined by a mid-level protuberance 64(*a*).

As shown in the embodiment of FIG. 6, zombie 58 is constructed to have two rotor shafts connecting shell 64 to a rotary/linear motion control. In this regard, a solid rotor shaft 72 connects the motion controller 66 to the face plate 68. A hollow rotor shaft 74 is positioned circumferentially around the solid rotor shaft 72 and is connected to armature 62. The dual rotor system achieves rotation, translation, as well as, contortion of the shell. That is, rotor 72 is designed to rotate the entire zombie without causing a change in the shape of the zombie. On the other hand, rotor shaft 74 is designed to rotate independently of rotor shaft 72. In this regard, rotor shaft 74 rotates relative to shaft 72 which results in the actuator 62 rotating relative to the solid rotor shaft 72. As a result, the shape of the zombie contorts. Specifically, the shell is caused to twist around the linear axis defined by the solid rotor 72. One skilled in the art will appreciate that the dual rotor system includes a transmission or similar driving mechanism (not shown) to selectively rotate the rotor shafts independently or in tandem.

Figure 7:
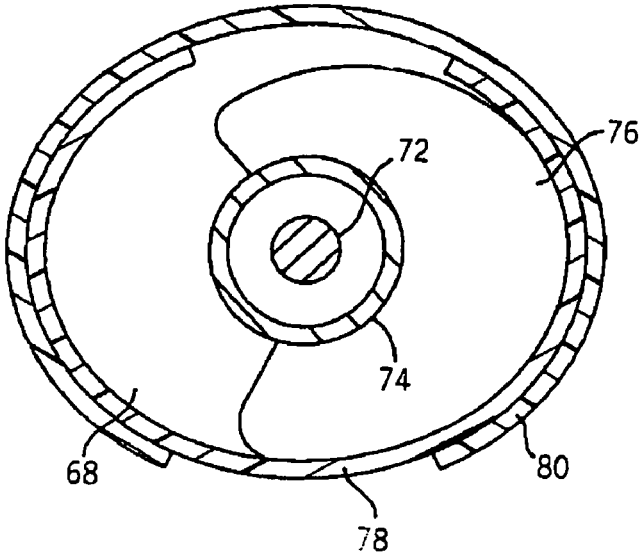
FIG. 7 is a partial end view of the x-ray attenuating fluid displacement device illustrated in FIG. 6.

Shown in FIG. 7 is an end view of the zombie of FIG. 6 illustrating one exemplary connection of the hollow rotor shaft and the solid rotor shaft. In this example, the hollow rotor shaft is connected to cam 76 and the zombie face plate 68 is connected to the solid rotor shaft 72. One skilled in the art will appreciate that rotation of the hollow rotor causes rotation of cam 76. Cam 76 is connected to an inner spring 78 such that rotation of the cam biases spring 78 relative to spring 80. Spring 80 is connected to the face plate 68. Therefore, rotation of the hollow rotor shaft effectuates a change in the shape of the zombie.

It is understood that the motion controller 66, FIG. 6, may include a transmission (not shown) to selectively cause rotation of shafts 72 and 74. Further, it is contemplated that the transmission may include a rack and pinion or other gear arrangement to cause translation of the zombie. In this regard, the transmission may include a gear arrangement that causes independent rotation of rotor shaft 72 to effectuate a given orientation of the zombie in the fluidic envelope. The transmission may also include a gear arrangement that causes rotation of the hollow rotor shaft without rotation of the solid rotor shaft to effectuate shaping of the zombie and another gear arrangement, such as the aforementioned rack and pinion arrangement, to translate the zombie. In addition to geared arrangements, it is contemplated that rotation, translation, shaping, and tilting of the zombie can be achieved using hydraulic, pneumatic, and/or electrical circuits. Further, it is contemplated that a single or multiple motor/motion controllers may be used to effectuate rotation, translation, shaping, and/or tilting of the zombie.

As illustrated in FIG. 6 and described herein, the zombie may have a complex shape, such as a shape that is generally matched to that of a medical patient. The zombie may also have a more simple shape, such as the frustoconical zombie illustrated in the embodiments of FIGS. 4-5. While a number of complex shapes are contemplated, in one preferred embodiment, the shape is preferably matched to that of a medical patient, as illustrated in FIG. 6. As shown, the zombie has a protuberance 64(*a*) that generally replicates a shoulder of a patient so that a general "neck" gradient 64(*b*) is also formed.

Regardless of shape, it is preferred that the zombie be formed of deformable, pliable material so that the shape of the zombie can be changed. In a preferred embodiment, the zombie is constructed of viscoelastic or elastomeric material that retains its shape after external forces are removed therefrom. In this regard, when the zombie is not being contorted or after being contorted, the zombie will have its static or "natural" shape. Therefore, in a preferred embodiment, the zombie is constructed to have a shape suitable for whole body imaging of a medical patient. As such, the bowtie filter, by displacement of its attenuating fluid, is shaped for whole body imaging by default. However, as needed, the zombie's shape, position, and orientation can be adjusted, as described herein, to achieve differing bowtie filtering profiles as those profiles are needed for targeted anatomy imaging or whole body scans that require other than the default filtering profile. In particular, rotation of the zombie in concert with the rotation of the gantry system around the patient is envisioned.

To achieve the variety in filtering profiles, it is contemplated that the zombie may be translated in the x, y, and z directions. In a preferred embodiment, the zombie is designed to be rotated relative to the z-direction (the axis defined lengthwise through the bore of the CT system), but could also be constructed to rotate relative to the x or y directions.

As described above, it is contemplated that the zombie shell may be filled with foam, air, or other material. It is further contemplated that the zombie may be connected to a pump (not shown) to effectively add and remove air or other fluid from the zombie shell. In this regard, the inventors contemplate inflation as well as deflation of the zombie to achieve changes in zombie size. For this embodiment, the bowtie filter should be constructed of somewhat pliable material also to accommodate an increase in zombie size. However, it is also contemplated that attenuating fluid may be added or removed and its pressure changed as needed to account for variations in zombie size.

Figure 8:
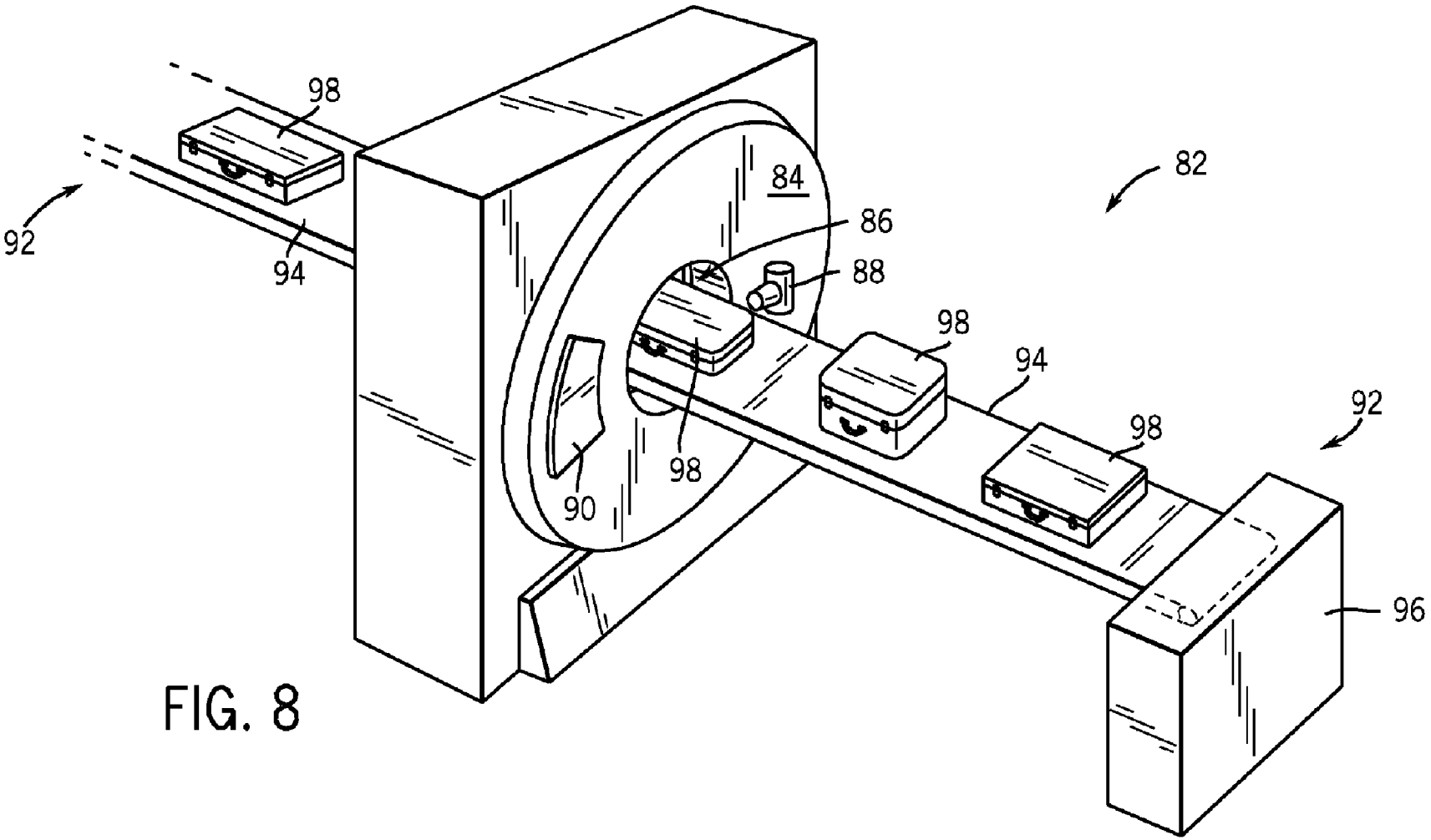
FIG. 8 is a pictorial view of a CT system for use with a non-invasive package inspection system.

Referring now to FIG. 8, package/baggage inspection system 82 includes a rotatable gantry 84 having an opening 86 therein through which packages or pieces of baggage may pass. The rotatable gantry 84 houses a high frequency electromagnetic energy source 88 as well as a detector assembly 90. A conveyor system 92 is also provided and includes a conveyor belt 94 supported by structure 96 to automatically and continuously pass packages or baggage pieces 98 through opening 86 to be scanned. Objects 98 are fed through opening 86 by conveyor belt 94, imaging data is then acquired, and the conveyor belt 94 removes the packages 98 from opening 86 in a controlled and continuous manner. As a result, postal inspectors, baggage handlers, and other security personnel may non-invasively inspect the contents of packages 98 for explosives, knives, guns, contraband, etc.

Accordingly, the present invention includes an x-ray attenuating filter having an envelope containing x-ray attenuating fluid. The filter further has a fluid displacement device disposed within the envelope and configured to displace the x-ray attenuating fluid to define a desired attenuation profile for the filter.

A CT system having an x-ray source, an x-ray detector, and an x-ray filter assembly is also presented. The x-ray filter assembly includes a bowtie filter having a body with attenuating fluid disposed therein as well as an attenuating fluid displacement device sealingly enclosed within the body of the bowtie filter. The filter assembly further has a mechanized actuator connected to the attenuating fluid displacement device to dynamically position the attenuating fluid displacement device within the body of the bowtie filter to define a desired filtering profile for the bowtie filter.

An x-ray filter having a fluidic envelope is also disclosed. The fluidic envelope contains x-ray attenuating fluid that is designed to filter x-rays projected from the x-ray source toward an object to be scanned. The x-ray filter further has means for displacing the attenuating fluid within the fluidic envelope to achieve a desired x-ray filtering profile to prevent detector saturation during scanning of the object.

An x-ray filter is also presented that includes a fluidic envelope having x-ray attenuating fluid disposed therein. The x-ray attenuating fluid includes at least one of liquid metal, nanoparticles suspended in a non-settling solution, or a compound with pH control buffer dissolved in a liquid.

The present invention has been described in terms of the preferred embodiment, and it is recognized that equivalents, alternatives, and modifications, aside from those expressly stated, are possible and within the scope of the appending claims.

What is claimed is:

1. An x-ray attenuating filter comprising:

an envelope containing x-ray attenuating fluid;

a fluid displacement device disposed within the envelope and configured to displace the x-ray attenuating fluid, the fluid displacement device having a shell having one of foam or air sealing disposed therein;

an actuator; and wherein the shell is operable connected to the actuator at one end and connected to a fixed point at another end and wherein the actuator is configured to rotate the one end relative to the fixed point to re-shape the shell.

2. The filter of claim 1 wherein the shell is operable connected to the actuator at one end and connected to a fixed point at another end, and wherein the actuator is configured to translate the one end at least one of toward or away from the fixed point to re-shape the shell.

3. The filter of claim 1 wherein the fluid displacement device has a frustoconical shape.

4. The filter of claim 1 wherein the fluid displacement device has a complex, noncylindrical shape being non-uniformed around a three dimensional axis.

5. The filter of claim 1 wherein the fluid displacement device has a shape of geometric proportions similar to the object to be scanned.

6. The filter of claim 1 wherein the x-ray attenuating fluid includes of one liquid metal or high-density powder suspended in a non-settling colloidal suspension.

7. The x-ray filter of claim 6 wherein high-density powder suspended in a non-settling colloidal suspension includes $Na_2WO_4$ in a solution of water, oil, organic liquid, or non-organic liquid.

8. The filter of claim 1 wherein the envelope has a general bowtie shape.

9. The filter of claim 1 wherein the fluid displacement device is configured to be at least one rotated or translated during an active radiographic scan.

10. The x-ray filter, of claim 1 wherein the x-ray attenuating fluid is at least one of:

liquid metal;

nanoparticles suspended in a non-settling solution; or a compound with pH control buffer dissolved in a liquid.

11. The x-ray filter of claim 10 wherein the liquid metal includes liquid mercury, wherein nanoparticles include high density powder, wherein the non-settling solution is a colloidal suspension, and wherein the compound includes salt.

12. The x-ray filter of claim 10 wherein the nanoparticles include tungsten oxide.

13. The filter of claim 1 wherein the shell is formed of pliable material.

14. The filter of claim 13 wherein the pliable material includes a viscoelastic material.

15. A CT system comprising an x-ray source, an x-ray detector, and an x-ray filter assembly disposed between the x-ray detector and the x-ray source along a path of irradiation, the x-ray filter assembly having:

a bowtie filter having a body with an x-ray attenuating fluid disposed therein;

an x-ray attenuating fluid displacement device sealingly enclosed within the body of the bowtie filter; and a mechanized actuator connected to the x-ray attenuating fluid displacement device to dynamically position the attenuating fluid displacement device within the body of the bowtie filter to define a desired filtering profile for the bowtie filter.

16. The system of claim 15 wherein the mechanized actuator includes a motor connected to the x-ray attenuating fluid displacement device by a rotatable shaft, the rotatable shaft configured to rotate the attenuating displacement device.

17. The system of claim 15 wherein the mechanized actuator includes a motion controller connected to the x-ray attenuating fluid device by a first rotor shaft disposed concentrically within a second rotor shaft, the first rotor shaft designed to contort the attenuating fluid displacement device and the second rotor shaft designed to rotate the attenuating fluid displacement device.

18. The system of claim 15 wherein the mechanized actuator is designed to at least one of compress, stretch, or twist the x-ray attenuating fluid displacement device to a desired 3D shape.

19. The system of claim 15 wherein the x-ray attenuating fluid displacement device has an elastomeric shell with one of air or foam disposed therein.

20. The system of claim 15 wherein the x-ray attenuating fluid includes alkali halide salts in water.

* * * * *